US009009953B2

(12) United States Patent
Ueda et al.

(10) Patent No.: US 9,009,953 B2
(45) Date of Patent: Apr. 21, 2015

(54) MANUFACTURING APPARATUS FOR FLATTENED TUBE FINS

(75) Inventors: Akio Ueda, Tokyo (JP); Toshiyuki Nanaarashi, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 362 days.

(21) Appl. No.: 13/401,372

(22) Filed: Feb. 21, 2012

(65) Prior Publication Data

US 2012/0222293 A1 Sep. 6, 2012

(30) Foreign Application Priority Data

Mar. 4, 2011 (JP) ..... 2011-048082

(51) Int. Cl.
*B21D 53/08* (2006.01)
*B21D 53/02* (2006.01)

(52) U.S. Cl.
CPC ..... *B21D 53/08* (2013.01); *B21D 53/022* (2013.01)

(58) Field of Classification Search
USPC ..... 29/726, 727, 819, 33 S, 33 Q, 564.8, 29/564.7, 564.6, 564.3, 564.1, 417, 412, 29/413, 415; 72/405.1–405.16, 405.06, 72/405.08, 405.09, 322, 337, 338, 339, 72/404, 405.01; 414/793, 793.1, 792.7
See application file for complete search history.

(56) References Cited

U.S. PATENT DOCUMENTS 1,205,951 A * 11/1916 Brady ..... 414/790.9
1,340,225 A * 5/1920 Howard ..... 225/2
1,565,840 A * 12/1925 Wise ..... 414/788.9
1,615,763 A * 1/1927 Kaufmann ..... 414/791.3
2,327,103 A * 8/1943 Gude ..... 83/94
2,692,072 A * 10/1954 Friedli, Jr. ..... 414/792.7
2,836,018 A * 5/1958 Key ..... 451/58
2,859,859 A * 11/1958 Winkel et al. ..... 414/790.4
3,165,871 A * 1/1965 Roth et al. ..... 53/247
3,193,078 A * 7/1965 Amenta et al. ..... 198/419.1

(Continued)

FOREIGN PATENT DOCUMENTS

JP 59190118 A * 11/1984 ..... B65G 57/04
JP 5-192728 A 8/1993

(Continued)

OTHER PUBLICATIONS

English translation of JP 2003-320433 A obtained from http://worldwide.espacenet.com on Mar. 20, 2014.*

*Primary Examiner* — David Bryant
*Assistant Examiner* — Jason L Vaughan
(74) *Attorney, Agent, or Firm* — Birch, Stewart, Kolasch & Birch, LLP

(57) ABSTRACT

A manufacturing apparatus manufactures flattened tube fins in which cutaway portions for inserting flattened tubes for heat exchanging are formed. The manufacturing apparatus includes: a press apparatus with a mold apparatus that forms the cutaway portions in an unmachined metal thin plate to produce a metal strip; an inter-row slit apparatus cutting the metal strip with the formed cutaway portions into predetermined widths to form metal strips of product width arranged in the width direction; and a cutoff apparatus cutting each metal strip of the product width formed by the inter-row slit apparatus into predetermined lengths. A plurality of box-like magazines whose upper surfaces are open are arranged in the width direction downstream of the cutoff apparatus to stack the flattened tube fins formed by the cutoff apparatus cutting into lengths.

12 Claims, 5 Drawing Sheets

(56) References Cited

U.S. PATENT DOCUMENTS

| | | | | | |
|---|---|---|---|---|---|
| 3,512,336 | A * | 5/1970 | Rosecrans | 53/537 |
| 3,996,723 | A * | 12/1976 | Greenwell | 53/500 |
| 4,236,855 | A * | 12/1980 | Wagner et al. | 414/789.5 |
| 4,434,638 | A * | 3/1984 | Sivachenko | 72/130 |
| 4,566,954 | A * | 1/1986 | Nogami et al. | 205/155 |
| 4,580,336 | A * | 4/1986 | Kerley et al. | 29/605 |
| 5,078,001 | A * | 1/1992 | Bakermans | 72/324 |
| 5,349,841 | A * | 9/1994 | Honma et al. | 72/333 |
| 6,345,425 | B1 * | 2/2002 | Rosasco et al. | 29/33 D |
| 6,871,478 | B2 * | 3/2005 | Edwards | 53/449 |
| 2008/0138187 | A1 * | 6/2008 | Christ | 414/793 |

FOREIGN PATENT DOCUMENTS

| | | | |
|---|---|---|---|
| JP | 7-091873 | A | 4/1995 |
| JP | 2003-320433 | A | 11/2003 |

* cited by examiner

MANUFACTURING APPARATUS FOR FLATTENED TUBE FINS

CROSS-REFERENCE TO RELATED APPLICATION(S)

This application is based upon and claims the benefit of priority of the prior Japanese Patent Application No. 2011-048082, filed on Mar. 4, 2011, the entire contents of which are incorporated herein by reference.

FIELD

The present invention relates to a method of manufacturing fins for a heat exchanger that uses flattened tubes.

BACKGROUND

An existing heat exchanger, such as an air conditioner, is typically constructed by stacking a plurality of heat exchanger fins, in which a plurality of through-holes have been formed to enable heat exchanger tubes to be inserted.

Such heat exchanger fins are manufactured by a manufacturing apparatus for heat exchanger fins depicted in FIG. 5.

The manufacturing apparatus for heat exchanger fins is equipped with an uncoiler 12 where a thin metal plate 10 made of aluminum or the like has been wound into a coil. The metal strip 10 pulled out from the uncoiler 12 via pinch rollers 14 is inserted into an oil applying apparatus 16 where machining oil is applied onto the surface of the metal strip 10, and is then supplied to a mold apparatus 20 provided inside a press apparatus 18.

The mold apparatus 20 internally includes an upper mold die set 22 that is capable of up-down movement and a lower mold die set 24 that is static. A plurality of collar-equipped through-holes (not illustrated), where collars of a predetermined height are formed around through-holes, are formed at predetermined intervals in a predetermined direction by the mold apparatus 20.

The result of machining the metal thin plate to produce the through-holes and the like is hereinafter referred to as the "metal strip 11". After being conveyed a predetermined distance in the predetermined direction, the metal strip 11 is cut into predetermined lengths by a cutter 26. The products (heat exchanger fins) produced by such cutting into predetermined lengths are stored in a stacker 28. The stacker 28 has a plurality of pins 27 erected in the perpendicular direction and stacks the manufactured heat exchanger fins by inserting the pins 27 into the through holes.

Patent Document 1

Japanese Laid-Open Patent Publication No. 1105-192728

SUMMARY

On an existing heat exchanger fin, a plurality of through-holes into which heat exchanger tubes are inserted are formed in a metal strip. However, at present, heat exchangers that use multi-channel flattened tubes are being developed. A heat exchanger fin that uses such flattened tubes is depicted in FIGS. 6A and 6B (and will sometimes be referred to hereinafter as a "flattened tube fin")

On a flattened tube fin 30, cutaway portions 34 into which the flattened tubes 32 are inserted are formed at a plurality of positions, and plate-like portions 36, where louvers 35 are formed, are formed between cutaway portion 34 and cutaway portion 34.

The cutaway portions 34 are formed from only one side in the width direction of the fin 30. Accordingly, the plate-like portions 36 between cutaway portion 34 and cutaway portion 34 are joined by a joining portion 38 that extends along the length direction.

However, when such flattened tube fin is manufactured by an existing heat exchanger fin manufacturing apparatus, the following problem occurs.

An existing heat exchanger fin has a plurality of through-holes formed therein and the manufactured fins are stacked in a stacker 28 where pins 27 are disposed so as to pass through the through-holes. However, since through-holes are not formed in the flattened tube fin described above, when stacking the fins, it is not possible to insert pins so as to align the fins. Also, since a flattened tube fin does not have a shape that is symmetrical in the width direction, the weight balance of a flattened tube is off-center in the width direction, so it would be conceivable for problems to occur even during simple stacking of the flattened tube fins.

As a result, when manufacturing flattened tube fins, there is the problem of how the flattened tube fins should be stacked.

The present invention was conceived to solve the problem described above and has an object of providing a manufacturing apparatus capable of reliably manufacturing flattened tube fins in which through-holes are not formed.

A flattened tube fin manufacturing apparatus according to an aspect of the present invention manufactures flattened tube fins in which cutaway portions, into which flattened tubes for heat exchanging are inserted, are formed from one side toward another side in a width direction, the flattened tube fin manufacturing apparatus including: a press apparatus equipped with a mold apparatus that forms the cutaway portions in an unmachined thin plate of metal to produce a metal strip; an inter-row slit apparatus which cuts the metal strip, in which the cutaway portions have been formed, into predetermined widths to form a plurality of metal strips of a product width that are arranged in the width direction; and a cutoff apparatus that cuts each of the plurality of metal strips of the product width formed by the inter-row slit apparatus into predetermined lengths, wherein a plurality of box-like magazines whose upper surfaces are open are arranged in the width direction downstream of the cutoff apparatus so as to stack the flattened tube fins formed by the cutoff apparatus cutting into the predetermined lengths.

With the above construction, it is possible to use a plurality of magazines that are aligned in the width direction to stack the manufactured flattened tube fins. The magazines are box-shaped and are surrounded by wall portions except for the upper surface. For this reason, even if there are no through-holes into which pins can be inserted as with flattened tube fins and the left-right weight balance is off center, it will still be possible to stably stack the fins in the magazines that are surrounded by the wall portions, which means manufacturing can be carried out easily and reliably.

Also, the respective metal strips of the product width that are arranged in the width direction may be caused to advance into the cutoff apparatus with the metal strips of the product width a predetermined gap apart.

With this construction, it is possible to reliably store the manufactured flattened tube fins in the magazines. That is, the respective magazines are formed in box shapes, which means that the respective wall portions have a certain thickness. When a plurality of magazines are adjacently disposed in the width direction, the enclosures of the magazines become located the thicknesses of the wall portions apart. However, if the thin metal plate were cut into a plurality of pieces in the width direction by the inter-row slit apparatus and the gaps between the respective flattened tube fins after cutting by the cutoff apparatus were insufficient, displacements would occur between the positions of the enclosures of the magazines and the positions of the flattened tube fins, which would prevent the flattened tube fins from being reliably stored in the magazines. For this reason, by using the construction described above and causing the metal strips to advance into the cutoff apparatus a predetermined gap apart in the width direction, it is possible to form the flattened tube fins at positions that match the enclosures of the magazines.

The cutoff apparatus may be internally equipped with a feeding apparatus that feeds the metal strips formed by the mold apparatus and the inter-row slit apparatus in a conveying direction, and a shuttle feeder apparatus, which grasps front ends on a downstream side in the conveying direction of the metal strips formed by the mold apparatus and the inter-row slit apparatus and pulls the metal strips in the conveying direction, may also be provided.

With this construction, when storing the metal strips that have been fed out of the cutoff apparatus in the magazines, it is possible to reliably convey the metal strips above the magazines Also, in the cutoff apparatus, the feeding apparatus may start a feeding operation for the metal strips at the same time as a start of a pulling operation by the shuttle feeder apparatus or before a start of a pulling operation by the shuttle feeder apparatus, and a cutting apparatus that cuts the metal strips into predetermined lengths after completion of a pulling operation by the shuttle feeder apparatus may be provided.

With this construction, since the metal strips are fed out of the cutoff apparatus at the same time or before the pulling operation by the shuttle feeder apparatus, the metal strips are reliably fed out without an excessive pulling operation by the shuttle feeder apparatus.

Note that it is also possible to provide a suction apparatus that is disposed above the magazines, vacuum chucks upper surfaces of the metal strips that have been pulled by the shuttle feeder apparatus after an end of a pulling operation, descends to a periphery of openings in the upper surfaces of the magazines while vacuum chucking the flattened tube fins that have been formed by the cutoff apparatus cutting into predetermined lengths after the clamping of the metal strips by the shuttle feeder apparatus has been released, and releases the vacuum chucking of the flattened tube fins to drop and store the flattened tube fins in the magazines.

With this construction, it is possible to reliably store the flattened tube fins in the magazines.

On the metal strip formed by the mold apparatus, two products may be disposed facing one another so that open ends of the cutaway portions of the respective products are adjacent. By doing so, it is possible to improve the left-right load balance of the mold apparatus.

According to the present invention, it is possible to reliably manufacture flattened tube fins in which through-holes are not formed.

DESCRIPTION OF EMBODIMENT(S)

Figure 1:
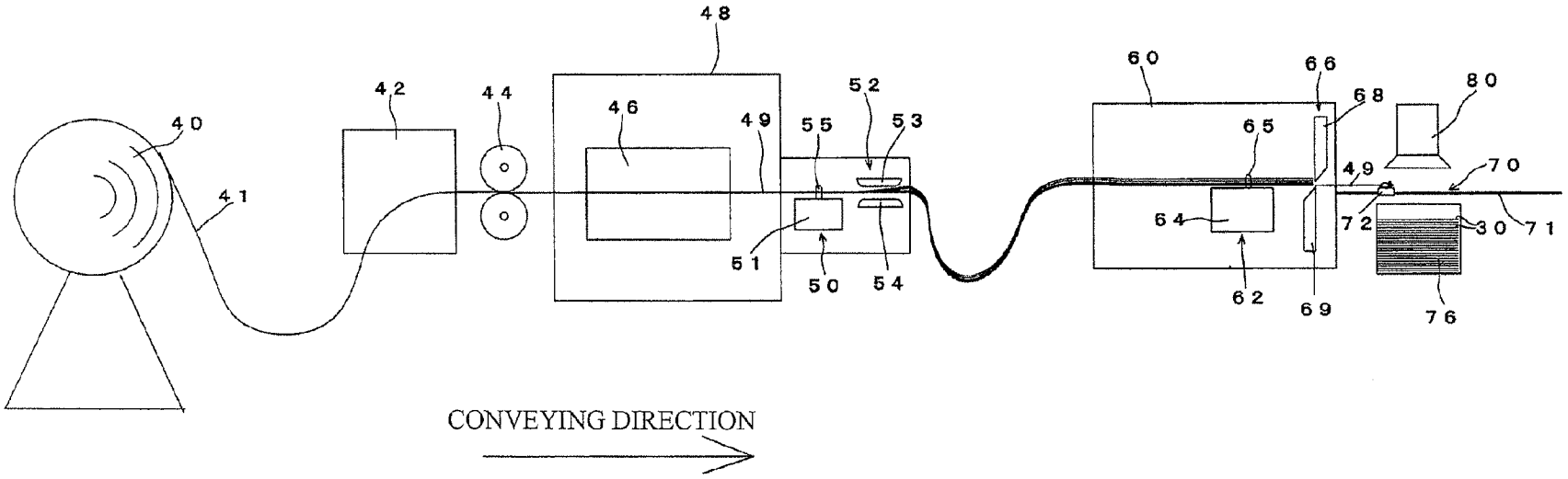
FIG. 1 is a simplified side view depicting the overall configuration of a manufacturing apparatus for flattened tube fins according to the present invention.

The overall configuration of a manufacturing apparatus for flattened tube fins according to the present invention is depicted in FIG. 1.

A thin metal plate 41 that is made of aluminum or the like and is yet to be machined is wound in a coil in an uncoiler 40. The thin plate 41 pulled out from the uncoiler 40 is inserted into a loop controller 42 and fluctuations in the thin plate 41 that is intermittently fed are suppressed by the loop controller 42.

An NC feeder 44 is provided downstream of the loop controller 42. The NC feeder 44 is composed of two rollers that touch the upper surface and the lower surface of the thin plate 41 and by rotationally driving the two rollers, the thin plate 41 is sandwiched and intermittently conveyed by the two rollers.

A press apparatus 48 that has a mold apparatus 46 disposed inside is provided downstream of the NC feeder 44. In the press apparatus 48, the thin plate 41 is formed into a metal strip 49 of a predetermined shape by the mold apparatus 46.

Figure 2:
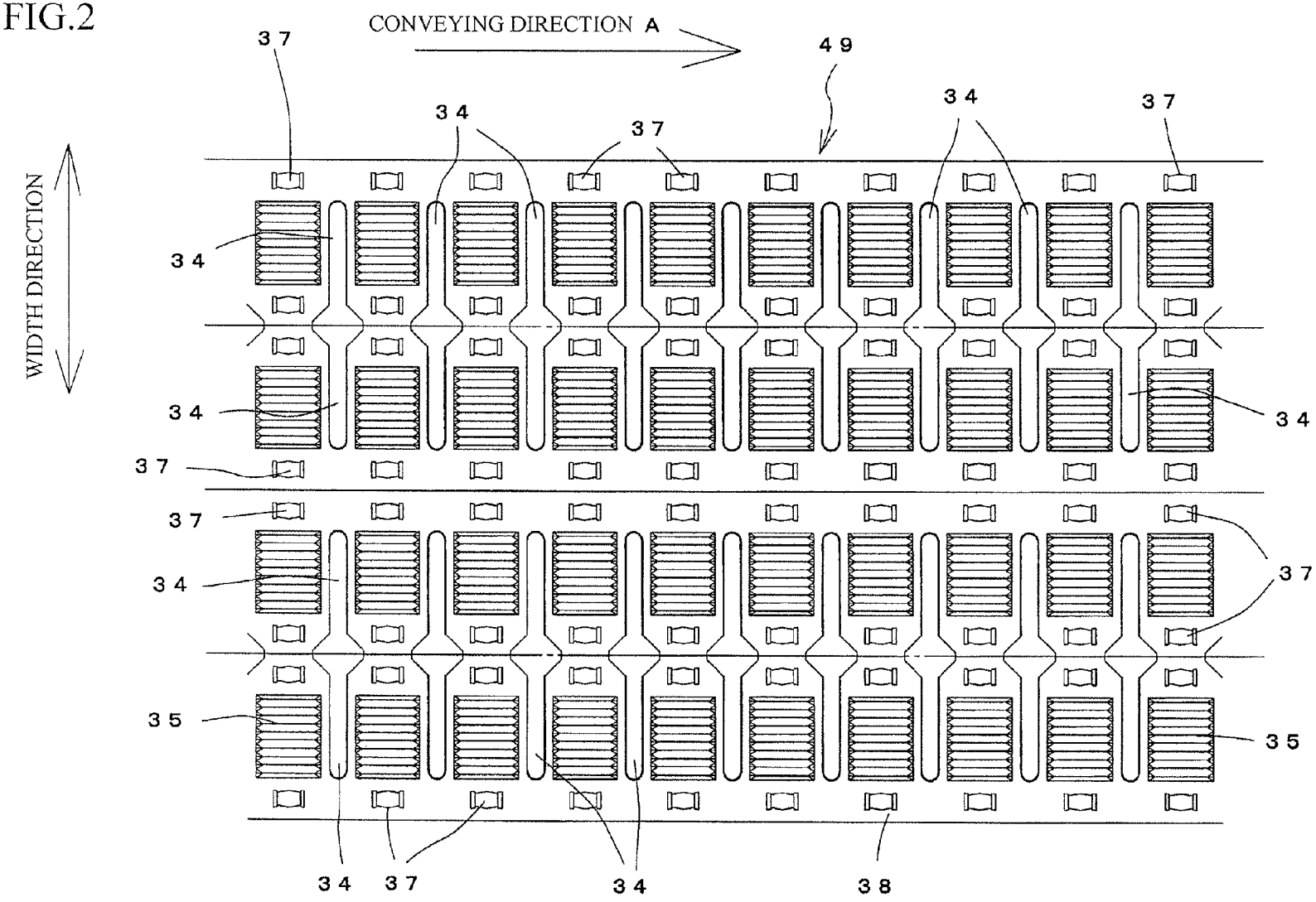
FIG. 2 is a plan view of a metal strip machined by the mold apparatus appearing in FIG. 1.

The metal strip 49 formed here is depicted in FIG. 2.

The metal strip 49 depicted in FIG. 2 has four products formed in a line in the width direction that is perpendicular to the conveying direction A.

Figures 6A, 6B:
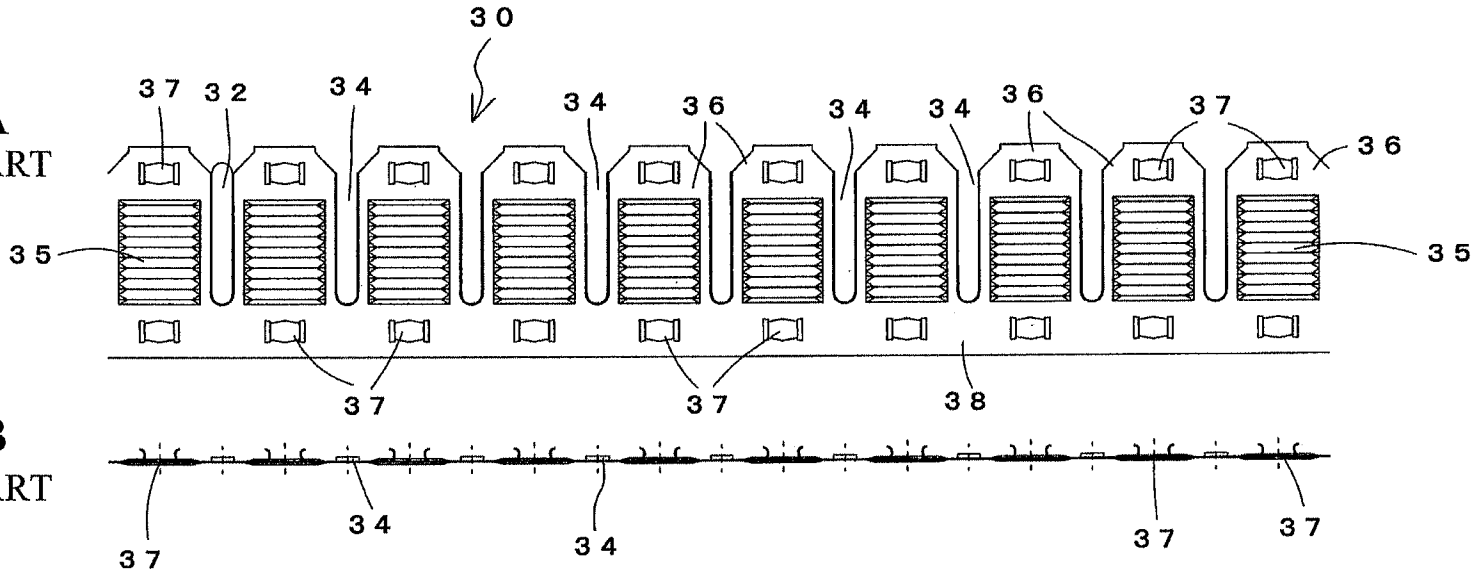
FIG.6A PRIOR ART
FIG.6B PRIOR ART
FIG. 6A is a plan view of a flattened tube fin and FIG. 6B is a side view of the flattened tube fin.

The respective products formed in the metal strip 49 are described with reference to FIG. 6A, and each have the cutaway portions 34 into which the flattened tubes 32 will be inserted formed at a plurality of positions and the plate-like portions 36, where louvers 35 are formed, formed between cutaway portion 34 and cutaway portion 34. Openings 37 formed by cutting and folding up the thin metal plate are formed at both end portions in the width direction of the louvers 35. Out of the two openings 37, 37 formed for one louver 35, one opening 37 is formed at a front end portion side of a plate-like portion 36.

The cutaway portions 34 are formed from only one side in the width direction of each fin 30. Accordingly, the plurality of plate-like portions 36 between cutaway portion 34 and cutaway portion 34 are joined by a joining portion 38 that extends in the length direction.

In each of the louvers 35, openings 37 are arranged in the width direction of the louver 35. One of the openings 37 is formed in the joining portion 38.

On the metal strip 49 depicted in FIG. 2, two products disposed with the open ends of the cutaway portions 34 adjacent to one another form a pair, and two of such pairs are formed. That is, the pairs, in which the open ends of the cutaway portions 34 of two products are disposed facing one another, are placed so that the joining portions 38 thereof are adjacent.

In this way, by disposing four products in an alternating arrangement, the left-right load balance of the mold is improved.

Note that unlike a metal strip such as that depicted in FIG. 2, if the open ends of the cutaway portions 34 of a plurality of products were disposed so as to all face in a single direction, when cutting is carried out between the products by an inter-row slit apparatus 52 (described later) that cuts out the products, there would be a high probability that cutting fragments (or "whiskers" or "cutting defects") would be produced between the cutaway portions 34 and the other positions due to displacements in the cutting position. Accordingly, when the open ends of the cutaway portions 34 of a plurality of products are all disposed so as to face in a single direction, it becomes necessary to cut not at the boundary of the openings of the cutaway portions 34 but to slightly extend the open parts of the cutaway portions 34 as far as a position advanced into a joining portion 38 and to cut at such position. However, in such case, the cross-section becomes stepped and there is deterioration in the left-right load balance of the mold. Accordingly, it is preferable to manufacture a plurality of products with the arrangement depicted in FIG. 2.

The description will now return to the overall construction of the manufacturing apparatus.

The metal strip 49 formed by the mold apparatus 46 in the press apparatus 48 is conveyed intermittently by a feeding apparatus 50 provided downstream of the press apparatus 48. The feed timing of the feeding apparatus 50 is provided so as to operate in concert with the NC feeder 44 and is capable of stable intermittent feeding.

In the feeding apparatus 50, a reciprocating unit 51 that is capable of moving in the horizontal direction moves reciprocally between an initial position and a conveyed position to pull the metal strip 49. Feed pins 55 that protrude upward are disposed on the upper surface of the reciprocating unit 51, the feed pins 55 advance from below into the cutaway portions 34 or the openings 37 formed in the metal strip 49, and the metal strip 49 is moved to a conveying position by pulling with the feed pins 55.

The inter-row slit apparatus 52 is provided downstream of the feeding apparatus 50. The inter-row slit apparatus 52 includes an upper blade 53 disposed on the upper surface side of the metal strip 49 and a lower blade 54 disposed on the lower surface side of the metal strip 49. The inter-row slit apparatus 52 may be provided so as to operate using an up-down movement operation of the press apparatus 48.

The upper blade 53 and the lower blade 54 are formed so as to be elongated in the conveying direction of the metal strip 49 and the intermittently fed metal strip 49 is cut by the upper blade 53 and the lower blade 54 coming together so as to manufacture products (referred to below as "metal strips of the product width") in the form of long strips in the conveying direction.

The plurality of metal strips 49 of the product width that have been cut to the product width by the inter-row slit apparatus 52 are fed into a cutoff apparatus 60.

Note that before feeding into the cutoff apparatus 60, the plurality of metal strips 49 of the product width are arranged with predetermined gaps (which depend on the plate thickness of the magazines described later, but are around 5 to 10 mm) between neighboring metal strips 49 of the product width. Before feeding into the cutoff apparatus 60, the plurality of metal strips 49 of the product width are temporarily accumulated for a length that is longer than the length of one conveying operation by the cutoff apparatus 60 and allowed to sag downward.

A feeding apparatus 62 that intermittently conveys the plurality of metal strips 49 of the product width in the conveying direction is provided inside the cutoff apparatus 60. As the construction of the feeding apparatus 62, a construction where it is possible to set the length of one feeding operation longer than the construction of the feeding apparatus 50 provided downstream of the press apparatus 48 is used.

In the feeding apparatus 62, a conveying unit 64 that is capable of moving in the horizontal direction moves by a predetermined distance to pull the metal strips 49 of the product width from the press apparatus 48 and push the metal strips 49 of the product width to the downstream side of the cutoff apparatus 60. On the upper surface of the conveying unit 64, a plurality of feeding pins 65 are disposed so as to protrude upward and are aligned in the horizontal direction in an equal number of rows to the number of metal strips 49 of the product width. The feeding pins 65 are inserted from below into the cutaway portions 34 or the openings 37 formed in the respective metal strips 49 of the product width, and due to being pulled by the feeding pins 65, the metal strips 49 of the product width move as far as a conveyed position.

A cutting apparatus 66 is provided downstream of the feeding apparatus 62.

The cutting apparatus 66 cuts the metal strips 49 of the product width into predetermined lengths to produce the final flattened tube fins 30. The cutting apparatus 66 includes an upper blade 68 disposed on the upper surface side of the metal strips 49 of the product width and the lower blade 69 disposed on the lower surface of the metal strips 49 of the product width.

By closing the upper blade 68 and the lower blade 69, the metal strips 49 of the product width are cut into predetermined lengths along the conveying direction to manufacture the flattened tube fins 30.

Figure 3:
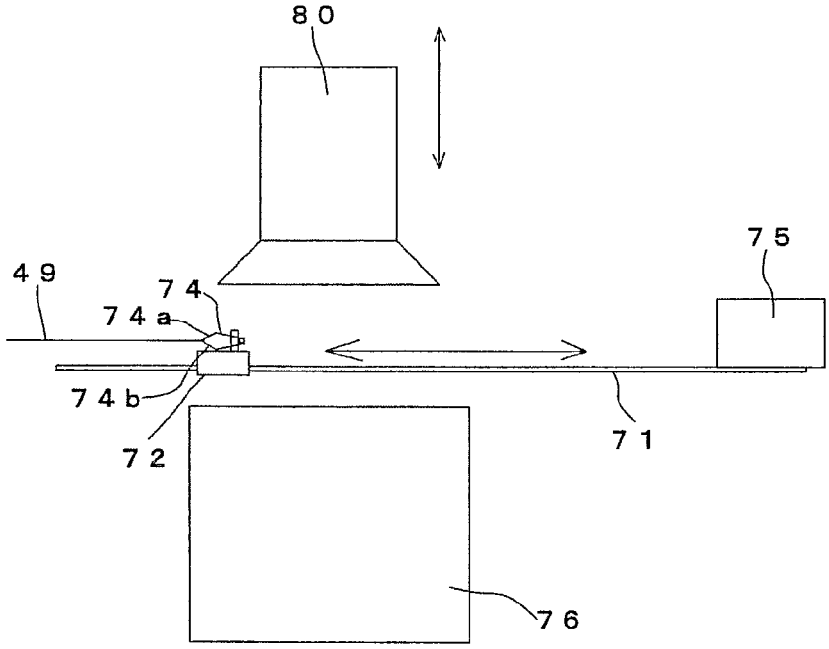
FIG. 3 is a diagram useful in explaining a part that stacks and stores manufactured flattened tube fins.

The construction downstream of the cutoff apparatus 60 is depicted in more detail in FIG. 3.

Downstream of the cutoff apparatus 60, a shuttle feeder apparatus 70 that pulls the metal strips 49 manufactured by the mold apparatus 46 and the inter-row slit apparatus 52 out of the cutoff apparatus 60 is provided.

The shuttle feeder apparatus 70 includes an elongated guide rail 71 that extends along the pulling direction, a base portion 72 that moves along the guide rail 71, and a clamp unit 74 that grasps an end portion of the metal strip 49 provided on the base portion 72.

The base portion 72 is provided so as to move reciprocally in a linear direction using a linear motor or a linear actuator.

The clamp unit 74 includes two claw portions 74*a*, 74*b* disposed in the up-down direction so as to sandwich the end portions of the metal strips 49 in the up-down direction. The two claw portions 74*a*, 74*b* are provided so as to be capable of freely opening and closing.

In the shuttle feeder apparatus 70, a control unit 75 that is capable of control that moves the base portion 72 in the linear direction and control over open and close operations of the clamp unit 74 is provided.

The control unit 75 of the shuttle feeder apparatus 70 executes an advancing operation of the base portion 72 and a clamping operation of the clamp portion 74 in concert with the feeding apparatus 62 inside the cutoff apparatus 60.

More specifically, the feeding apparatus 62 of the cutoff apparatus 60 operates so as to start a feeding operation at the same time as the start of a pulling operation by the shuttle feeder apparatus 70 or before the start of a pulling operation by the shuttle feeder apparatus 70. That is, according to control from the shuttle feeder apparatus 70, the pulling operation starts at the same time as the start of a feeding operation by the feeding apparatus 62 or after the start of a feeding operation by the feeding apparatus 62. By doing so, it is possible to reliably feed out the metal strips 49 without an excessive pulling operation by the shuttle feeder apparatus 70.

Figure 4:
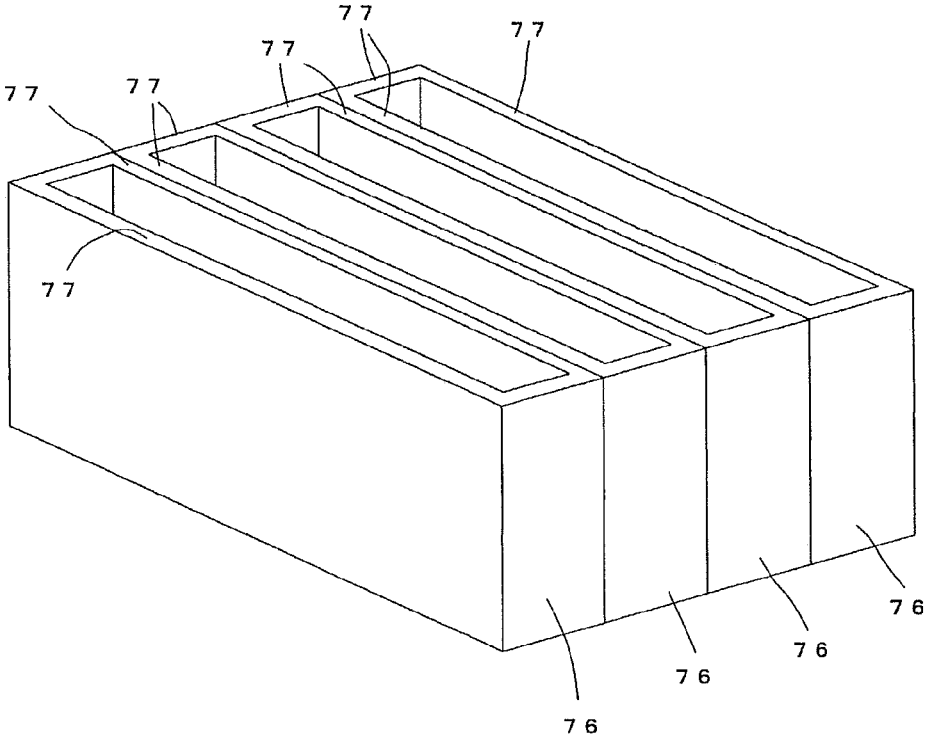
FIG. 4 is a perspective view of magazines.
Figure 5:
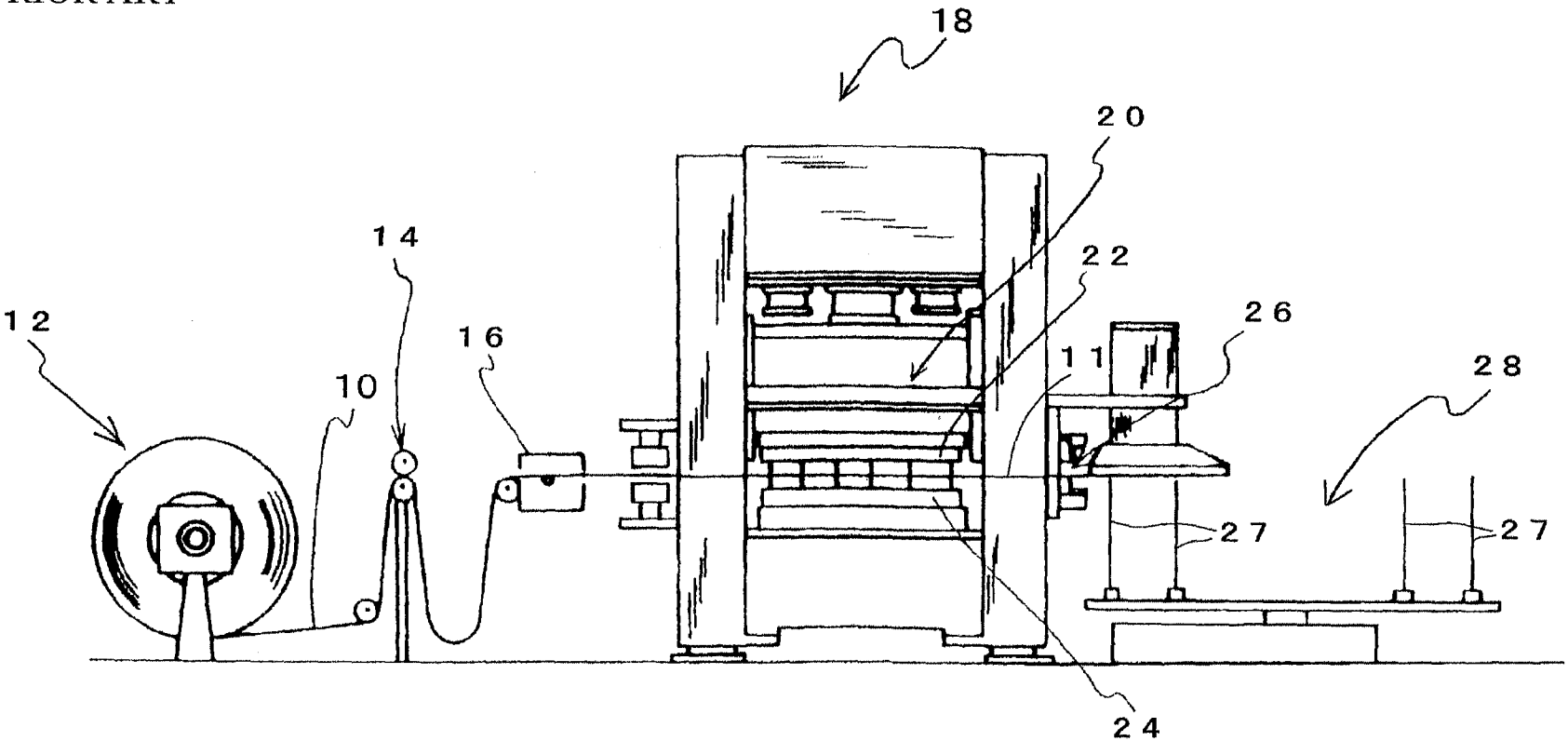
FIG.5 PRIOR ART
FIG. 5 is a simplified side view depicting the overall construction of an existing manufacturing apparatus for heat exchanger fins.

FIG. 4 is a perspective view of magazines.

Downstream of the cutoff apparatus 60, a number of magazines 76, which store the manufactured flattened tube fins 30, equal to the plural number of formed flattened tube fins 30 are disposed in the width direction (i.e., a direction that is perpendicular to the conveying direction) below the shuttle feeder apparatus 70.

Each magazine 76 is in the form of a box (a rectangular solid) whose upper surface is open, and the width and the length of the magazine 76 are set at a suitable size for the width and length of the flattened tube fins 30.

Since the respective magazines 76 are surrounded by wall portions 77 of a predetermined thickness, the open enclosures of adjacent magazines 76 are separated by a distance equal to double the thickness of the wall portions 77. Accordingly, if the metal strips 49 that have been pulled out from at least the cutoff apparatus 60 are separated in the width direction by a distance at least double the thickness of the wall portions 77 of the magazines 76, it will be possible to reliably store the flattened tube fins 30 in the magazines 76. This means that according to the present embodiment, as described above, the plurality of metal strips 49 of the product width before cutting are caused to advance into the cutoff apparatus 60 a predetermined gap apart.

A suction apparatus 80 is provided above the magazines 76. The suction apparatus 80 has a function that vacuum chucks the upper surfaces of the metal strips 49 pulled by the shuttle feeder apparatus 70, cuts the metal strips 49 into predetermined lengths using the cutting apparatus 66 to produce the flattened tube fins 30, then descends to the upper surface of the magazines 76 and releases the vacuum chucking so as to drop and store the flattened tube fins 30 in the magazines 76.

As the suction apparatus 80, it is possible to internally provide a suction pump (not illustrated), to chuck the upper surfaces of the metal strips 49 using a suction force of the suction pump, and then stop the suction of the suction pump to release the vacuum chucking of the flattened tube fins 30 and drop the flattened tube fins 30. When doing so, if an auxiliary mechanism (not illustrated) that presses the flattened tube fins 30 from the suction apparatus 80 side toward the magazines 76 is provided in the suction apparatus 80, it is possible to store the flattened tube fins 30 in the magazines 76 even more reliably.

The suction apparatus 80 is provided so as to be capable of up-down movement and such up-down movement operation and the suction operation are carried out in concert with a pulling operation and clamping operation by the shuttle feeder apparatus 70.

The clamp unit 74 of the shuttle feeder apparatus 70 clamps the metal strips 49 and pulls the metal strips 49 above the openings of the magazines 76. At this position, the suction apparatus 80 descends to the upper surfaces of the metal strips 49 and starts the suction operation. At the same time as the start of the suction operation of the suction apparatus 80, the clamping operation of the clamp unit 74 is released. After this, the metal strips 49 are vacuum chucked by the suction apparatus 80 and are cut into predetermined lengths by operating the cutting apparatus 66 at one end to form the metal strips 49 into the flattened tube fins 30.

After this, with the flattened tube fins 30 still vacuum chucked, the suction apparatus 80 descends as far as the periphery of the openings at the upper surfaces of the magazines 76. After this, the suction apparatus 80 that has descended to the periphery of the openings at the upper surfaces of the magazines 76 releases the suction to drop the flattened tube fins 30 that were being held into the magazines 76. Next, the suction apparatus 80 ascends to the original position above the shuttle feeder apparatus 70 and the suction apparatus 80 waits until the shuttle feeder apparatus 70 has pulled in new metal strips 49.

Note that a support apparatus (not illustrated) for keeping the posture of the stored flattened tube fins 30 horizontal inside the magazines 76 is provided below the magazines 76 or to the side of the wall portions 77, and the support position is lowered in keeping with the stacked height of the flattened tube fins 30 so that the dropping height of the flattened tube fins 30 maintains the minimum required distance.

Note that in the present embodiment, four flattened tube fins 30 are manufactured in parallel in the width direction from the unmachined thin metal plate 41. Accordingly, four magazines 76 that stack and store the flattened tube fins 30 after manufacturing are provided adjacent to one another in the width direction.

However, the present invention is not limited to manufacturing four flattened tube fins 30 in parallel in the width direction and as one example may be provided so as to manufacture five or more flattened tube fins 30 in parallel, with five or more magazines 76 also being provided. However, in order to maintain the left-right balance of the mold, it is preferable when possible to dispose an even number of flattened tube fins 30 within the width direction of a single thin plate and to pair the flattened tube fins 30 so that the cutaway portions 34 face one another.

Although the present invention has been described above by way of the preferred embodiments, the present invention is not limited to such embodiments and it should be obvious that various modifications may be implemented without departing from the scope of the invention.

What is claimed is:

1. A flattened tube fin manufacturing apparatus that manufactures flattened tube fins in which cutaway portions, into which flattened tubes for heat exchanging are inserted, are formed from one side toward another side in a width direction, the manufacturing apparatus comprising:

a press apparatus equipped with a mold apparatus that forms the cutaway portions in an unmachined thin plate of metal to produce a metal strip;

an inter-row slit apparatus which cuts the metal strip, in which the cutaway portions have been formed, into predetermined widths to form a plurality of metal strips of a product width that are arranged in the width direction of the metal strip, which is a direction perpendicular to a conveying direction of the metal strip and which is a narrower direction; and a cutoff apparatus that cuts each of the plurality of metal strips of the product width formed by the inter-row slit apparatus into predetermined lengths, wherein a plurality of box-like magazines, in each of which an upper surface has an opening and other surfaces are surrounded by the wall portions, are arranged in the width direction downstream, on a downstream side of the cutoff apparatus in the conveying direction of the metal strip, so as to stack the flattened tube fins, in each of which a left-right weight balance is off centered, formed by the cutoff apparatus cutting into the predetermined lengths, the cutoff apparatus is internally equipped with a feeding apparatus that feeds the metal strips formed by the mold apparatus and the inter-row slit apparatus in a conveying direction, the flattening tube fin manufacturing apparatus further comprises a shuttle feeder apparatus that is separate to the feeding apparatus and grasps front ends on a downstream side in the conveying direction of the metal strips formed by the mold apparatus and the inter-row slit apparatus and pulls the metal strips in the conveying direction, and the shuttle feeder apparatus includes: an elongated guide rail that extends along a pulling direction; a base portion that moves along the guide rail, and a clamp unit with two hook portions disposed in an up-down direction so as to sandwich, in the up-down direction, an end portion of a metal strip provided on the base portion.

2. The flattened tube fin manufacturing apparatus according to claim 1, wherein the respective metal strips of the product width that are arranged in the width direction are caused to advance into the cutoff apparatus with the metal strips of the product width a predetermined gap apart.

3. The flattened tube fin manufacturing apparatus according to claim 1, wherein in the cutoff apparatus, the feeding apparatus starts a feeding operation for the metal strips at the same time as a start of a pulling operation by the shuttle feeder apparatus or before a start of a pulling operation by the shuttle feeder apparatus, and a cutting apparatus that cuts the metal strips into predetermined lengths after completion of a pulling operation by the shuttle feeder apparatus is provided.

4. The flattened tube fin manufacturing apparatus according to claim 3, further comprising a suction apparatus that is disposed above the openings of the magazines, wherein the suction apparatus starts to vacuum chuck the upper surfaces of the metal strips of the product width after an end of a pulling operation in which the shuttle feeder apparatus pulls the metal strips of the product width, descends to a periphery of the openings in the upper surfaces of the magazines while vacuum chucking the flattened tube fins that have been formed by the cutoff apparatus cutting into predetermined lengths after the clamping of the metal strips by the shuttle feeder apparatus has been released, and releases the vacuum chucking of the flattened tube fins to drop and store the flattened tube fins in the magazines.

5. The flattened tube fin manufacturing apparatus according to claim 1, further comprising a suction apparatus that is disposed above the openings of the magazines, wherein the suction apparatus starts to vacuum chuck the upper surfaces of the metal strips of the product width after an end of a pulling operation in which the shuttle feeder apparatus pulls the metal strips of the product width, descends to a periphery of the openings in the upper surfaces of the magazines while vacuum chucking the flattened tube fins that have been formed by the cutoff apparatus cutting into predetermined lengths after the clamping of the metal strips by the shuttle feeder apparatus has been released, and releases the vacuum chucking of the flattened tube fins to drop and store the flattened tube fins in the magazines.

6. The flattened tube fin manufacturing apparatus according to claim 1, wherein in the metal strip formed by the mold apparatus, two products are disposed facing one another so that open ends of the cutaway portions of the respective products are adjacent.

7. A flattened tube fin manufacturing apparatus for manufacturing flattened tube fins including cutaway portions for inserting flattened tubes for heat exchanging, said cutaway portions being formed from one side toward another side in a width direction, the manufacturing apparatus comprising:

a press apparatus equipped with a mold apparatus for forming the cutaway portions in an unmachined thin plate of metal to produce a metal strip;

an inter-row slit apparatus for cutting the metal strip, in which the cutaway portions have been formed, into predetermined widths to form a plurality of metal strips of a product width that are arranged in the width direction of the metal strip, said width direction being perpendicular to a conveying direction of the metal strip; and a cutoff apparatus for cutting each of the plurality of metal strips of the product width formed by the inter-row slit apparatus into predetermined lengths, wherein each of a plurality of box-like magazines includes an open upper surface, said plurality of box-like magazines being arranged in the width direction downstream of the cutoff apparatus in the conveying direction to stack the flattened tube fins formed by the cutoff apparatus cutting into the predetermined lengths, wherein the cutoff apparatus is internally equipped with a feeding apparatus for feeding the metal strips formed by the mold apparatus and the inter-row slit apparatus in the conveying direction, and the flattened tube fin manufacturing apparatus further comprises a shuttle feeder apparatus for grasping front ends on a downstream side in the conveying direction of the metal strips formed by the mold apparatus and the inter-row slit apparatus and for pulling the metal strips in the conveying direction.

8. The flattened tube fin manufacturing apparatus according to claim 7, wherein the respective metal strips of the product width that are arranged in the width direction are caused to advance into the cutoff apparatus with the metal strips of the product width a predetermined gap apart.

9. The flattened tube fin manufacturing apparatus according to claim 7, wherein in the cutoff apparatus, the feeding apparatus starts a feeding operation for the metal strips at the same time as a start of a pulling operation by the shuttle feeder apparatus or before a start of a pulling operation by the shuttle feeder apparatus, and further including a cutting apparatus for cutting the metal strips into predetermined lengths after completion of a pulling operation by the shuttle feeder apparatus is provided.

10. The flattened tube fin manufacturing apparatus according to claim 9, further comprising a suction apparatus positioned above the magazines, wherein the suction apparatus starts to vacuum chuck the upper surfaces of the metal strips of the product width after an end of a pulling operation in which the shuttle feeder apparatus pulls the metal strips of the product width, descends to a periphery of the openings in the upper surfaces of the magazines while vacuum chucking the flattened tube fins that have been formed by the cutoff apparatus cutting into predetermined lengths after the clamping of the metal strips by the shuttle feeder apparatus has been released, and releases the vacuum chucking of the flattened tube fins to drop and store the flattened tube fins in the magazines.

11. The flattened tube fin manufacturing apparatus according to claim 7, further comprising a suction apparatus positioned above the magazines, wherein said suction apparatus starts to vacuum chuck the upper surfaces of the metal strips of the product width after an end of a pulling operation in which the shuttle feeder apparatus pulls the metal strips of the product width, descends to a periphery of the openings in the upper surfaces of the magazines while vacuum chucking the flattened tube fins that have been formed by the cutoff apparatus cutting into predetermined lengths after the clamping of the metal strips by the shuttle feeder apparatus has been released, and releases the vacuum chucking of the flattened tube fins to drop and store the flattened tube fins in the magazines.

12. The flattened tube fin manufacturing apparatus according to claim 7, wherein in the metal strip formed by the mold apparatus, two products are disposed facing one another so that open ends of the cutaway portions of the respective products are adjacent.

* * * * *